United States Patent [19]

Linska

[11] Patent Number: 4,676,160

[45] Date of Patent: Jun. 30, 1987

[54] DOCTOR BLADE FOR USE IN AN INKER OF A PRINTING MACHINE

[75] Inventor: Rudolf Linska, Alsmoos, Fed. Rep. of Germany

[73] Assignee: M.A.N.-Roland Druckmaschinen Aktiengesellschaft, Augsburg, Fed. Rep. of Germany

[21] Appl. No.: 886,974

[22] Filed: Jul. 17, 1986

[30] Foreign Application Priority Data

Jul. 18, 1985 [DE] Fed. Rep. of Germany ..... 3525589

[51] Int. Cl.[4] ..... B41F 31/04

[52] U.S. Cl. ..... 101/365; 101/155; 101/169; 118/261

[58] Field of Search ..... 101/154, 155, 157, 167, 101/169, 365; 118/261; 15/256.51, 256.52

[56] References Cited

U.S. PATENT DOCUMENTS

| | | | |
|---|---|---|---|
| 1,871,013 | 8/1932 | Shakespeare | 118/261 |
| 2,283,830 | 5/1942 | Taylor | 101/365 |
| 2,837,024 | 6/1958 | Dougan | 101/365 |
| 3,356,067 | 12/1967 | Krasnow et al. | 118/261 |
| 3,529,315 | 9/1970 | Dunlap et al. | 15/256.51 |
| 3,855,927 | 12/1974 | Simeth | 101/169 |

FOREIGN PATENT DOCUMENTS

| | | |
|---|---|---|
| 2228625 | 7/1974 | Fed. Rep. of Germany . |
| 2460116 | 7/1976 | Fed. Rep. of Germany . |

*Primary Examiner*—Edgar S. Burr
*Assistant Examiner*—James A. Lisehora
*Attorney, Agent, or Firm*—Frishauf, Holtz, Goodman & Woodward

[57] ABSTRACT

To provide for a tight fit between adjacent tongues (4, 4') subdividing a doctor blade (1), one edge (9) of a tongue (4) facing a slit (5) between the tongues is coated with a material substantially softer than the material of the doctor blade, for example galvanically deposited copper, with a thickness which is in excess of the width of the slit (5) separating the adjacent tongues (4, 4'). Upon closing of the tongues with respect to each other, after having been spread, the tongues will shear off the softer material so that the then formed remaining separation between the tongues will have effectively or quasi zero dimension, thus forming a tight fit between the tongues, while still permitting individual adjustability with respect to a roller against which the doctor blade is to operate.

8 Claims, 4 Drawing Figures

DOCTOR BLADE FOR USE IN AN INKER OF A PRINTING MACHINE

The present invention relates to printing machines, and more particularly to a doctor blade for use with an inker having an ink roller operating within an ink trough, and more specifically to a doctor blade which is subdivided by slits which extend radially with respect to the inker roller to form projecting tongues which can individually adjusted in relation to the inker roller to provide for individually controllable ink transfer in zones spaced axially along the roller.

BACKGROUND

German Patent Disclosure Document No. DE-OS 22 28 625, inventor Simeth, discloses a doctor blade for use in an inker of a printing machine in which the doctor blade is subdivided by slits, which slits are filled with a plastic material. Filling the slits with plastic material permits adjustment of the tongues formed by the subdividing slits, individually, with respect to the doctor blade so that the individual tongues are decoupled from each other to permit adjustment of one tongue, for example, without interfering with the position of an adjacent tongue. It has been found that in operation adjustment of two adjacent tongues in opposite direction may cause separation of the plastic layer between the respective tongues from the metallic material of which the doctor blade is usually made. It is customary to make doctor blades of spring steel or similar material. It appears that the cause for separation of plastic material from the doctor blade itself is based on insufficient adhesion of the plastic material on the metallic doctor blade with respect to shearing forces; in other words, the resistance to shearing occurring between the elastic filling material and the hard material of the doctor blade, in addition to the hydrostatic pressure occurring in operation of the printing machine, causes forces tending to separate the plastic material from the knives. The forces are substantial and act on the elastic filler material.

The elasticity of the filler material of the doctor material disclosed in the German Patent Disclosure Document No. DE-OS 22 28 625 causes the gap of the doctor blade, that is, the distance between the longitudinal edge of the doctor blade adjacent the inker roller and the inker roller itself to be different in the region of a slit, so that rings of ink will arise on the inker roller, which is undesirable. This effect may even increase if the filler material in the slits, in the metering range of the doctor blade, wears faster than the doctor blade itself.

It has previously been proposed to cover the slits between the tongues which will be the result of the slits, and which project towards the ink roller. U.S. Pat. No. 2,837,024 describes an arrangement in which the slits are covered. German Pat. No. 24 60 116 describes a cover in form of a foil, applied at the inside of the ink trough. This arrangement causes substantial wear on the foil, thus requiring frequent exchange of the foil elements. If a cover is applied, for example by adhesion, at the bottom of the doctor blade, the penetration of ink between the doctor blade and the cover is unavoidable. The cover may be adhered and, upon adjustment of the tongues for control of ink flow in the respective zones, ink may penetrate through the slits in the region of adhesion between the cover and the doctor blade, resulting, eventually, in undesirable removal of the foil from the doctor blade and, additionally, to drying of ink in the region of penetration which, eventually, will lead to inoperability of the doctor blade.

THE INVENTION

It is an object to improve a doctor blade in such a manner that undesirable escape of ink through the slits defining the tongues of the doctor blade is avoided, and which does not require elastic filler or sealing material in the slits.

Briefly, the tongues are coated at one side edge facing the slit with a material which is softer than the material of the doctor blade itself. Typically, the doctor blade is made of steel and a suitable coating is copper. A customary width of the slit between adjacent portions of the tongues of the doctor blade is is the order of about 0.05 mm. Upon coating an edge of one tongue, and then moving the other, uncoated edge of the adjacent tongue against the edge, the softer material will be sheared by the harder material of the tongue, so that the eventual clear slit between the tongues will be effectively zero or quasi zero. Copper could be applied to the edge of the tongue, for example by galvanic deposition.

DRAWINGS

DETAILED DESCRIPTION

Figure 1:
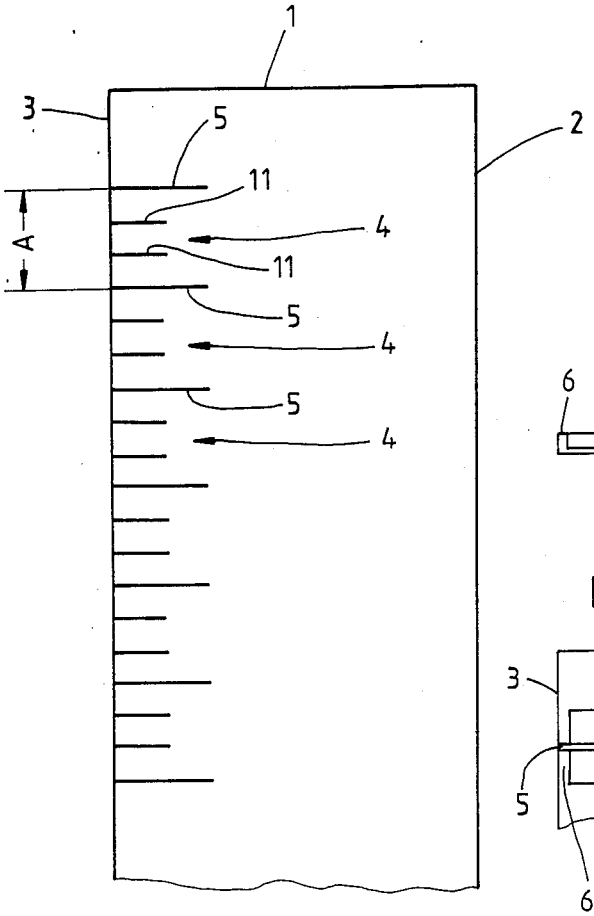
FIG. 1 is a top view of a doctor blade in the region adjacent an ink roller (not shown)

An ink doctor blade 1, shown only in part, has slits 5 cut therein, extending from edge 3. The edge 3, which forms an ink metering edge, is, in operation, placed against the surface of an ink roller of an inker of a printing machine, for example a sheet or web-type rotary printing machine. The doctor blade 1 is secured at its back edge 2, remote from the ink metering edge 3, to a suitable attachment arrangement—not shown—and which may be in accordance with any usual or customary construction. The slits 5 which extend from the metering edge 3 define between themselves tongues 4. The slits 5 are spaced apart to define the width of an inking zone A, extending axially along the ink duct roller (not shown). A usual dimension for an ink zone A is in the order of about 4 cm. The tongues 4 would then also have a dimension of about 4 cm, less the width of the slits 5.

In accordance with a preferred manufacturing process, the slits 5 formed at the front edge or metering edge 3 of the doctor blade 1 are made by a wire erosion machine. A typical width of the slits 5 is in the order of 0.05 mm. The slits 5 may be made by other processes, for example by laser beams.

Figure 2:
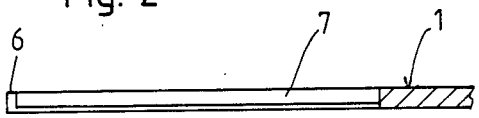
FIG. 2 is a cross-sectional bottom view through a slit in the doctor blade, taken upside-down with respect to FIG. 1 to better illustrate a relieved surface for placement of copper.
Figure 3:
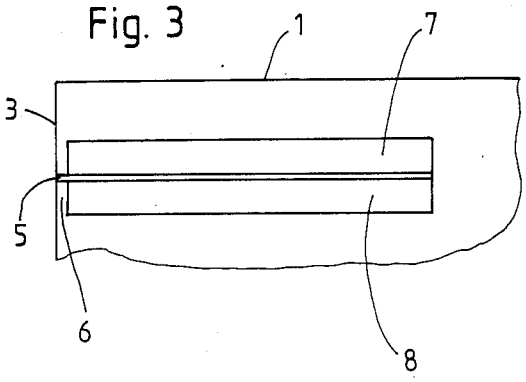
FIG. 3 is a bottom view of two adjacent tongues of the doctor blade, from below, in the region of a slit.

In accordance with a preferred embodiment of the invention, the slits 5 are first formed and then, after formation of the slits 5, the bottom side of the tongues 4 of the doctor blade 1 are relieved, so that recesses 7, 8—see FIG. 3—adjacent the slits 5 will result in the adjacent zones of neighboring tongues 4. FIG. 2 illustrates the recess 7 in side view, FIG. 2 showing the blade 1 upside-down. The recesses 7, 8 terminate approximately 1 mm in advance of the metering edge 3 of the tongues 4 of the doctor blade 1, so that a region 6 made of the hard springy material of the doctor blade will remain. Typically, the doctor blade is made of spring steel.

In accordance with a feature of the invention, a material 15, in form of a coating, is applied to one of the edges 9 of one of the tongues, which edge 9 faces the slit 5. This material 15 is softer than the material of the doctor blade 1. Preferably, the doctor blade 1 is made of spring steel, and the material is a metallic coating, for example copper. The material is applied to the edge side 9 by spreading apart adjacent tongues 4, 4' (see FIG. 4) and applying a copper layer 15 on the edge 9 by galvanic deposition. It is important to apply a layer 15 on the edge 9 which is slightly thicker than the width of the slit 5. This results in the advantage—a feature of the invention—that, upon closing of neighboring elastic tongues 4, 4', excess soft material is sheared off by the hard material of the doctor blade opposite the side of the slit of the tongue 4', which defines an edge 10. The previously made width of the slit 5 thus is effectively closed, so that the slit 5 will have a slit width of quasi zero or effectively zero dimension. This arrangement has the substantial advantage that the slit 5 has no remainig dimension, so that the adjacent tongues are tight with respect to each other so that no ink can run between the slits in operation of a printing machine. Additionally, uniform wear of the metering or working edge or front edge 3 of the doctor blade is insured, so that no undesirable increases in ink or depressions in the region of the slit 5 might occur. Adjustment of one tongue 4 with respect to a neighboring tongue 4' is always less than the thickness of the doctor blade 1, since the adjustment paths are very small.

Figure 4:
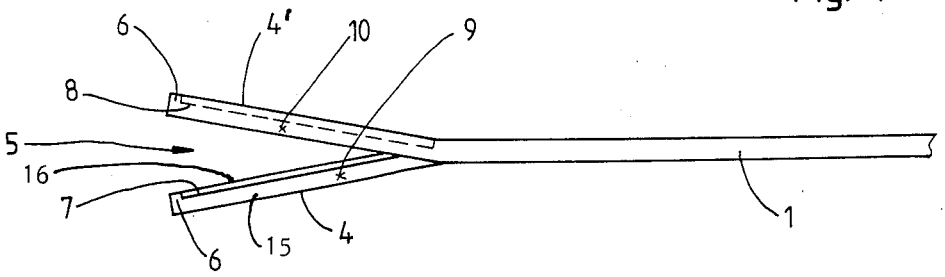
FIG. 4 is a bottom side view, illustrating two adjacent tongues, spread apart.

The spread of neighboring tongues 4, 4' shown in FIG. 4 is used merely to apply the copper layer, for example by galvanic deposition, or to facilitate such galvanic deposition. It is shown exaggerated in the drawing for clarity.

After applying the copper layer 15 at one of the edges facing the slit of one of the tongues, for example on tongue 4 on edge 9, and after shearing of excess applied copper by the adjacent, uncoated edge 10 of the neighboring tongue 4', the recesses 7, 8 can be filled with an elastic material 16, preferably a plastic material. This plastic material may be applied by casting plastic material into the respective recesses 7, 8 or by adhesion, which may include vulcanization. Covering the recesses 7, 8 with an elastic plastic layer provides additional protection with respect to undesired escape of ink if, for example, in the course of operation and due to wear, the slit would increase slightly. The protective layer also has the advantage that those portions of the tongues which still overlap, even when spread apart, and which cannot be entirely covered or covered only partially, can be sealed with respect to each other even though the slit in its original width of 0.05 mm, for example, remains. In the rearward region of the tongues, and hence of the slits, the hydrostatic pressure is substantially less, or has disappeared altogether. Interference of the adjustment path of the front portion of the tongues 4, for example due to hardened or caked ink, is no longer a problem in the rear region of the tongues.

Various changes and modifications may be made, and any material which is substantially softer than the material of the doctor blade itself, and which can be sheared therefrom—while being reliably secured thereon too—is suitable, with electrolytically deposited copper being preferred. Auxiliary slits 11 may be formed in the tongues 4, for example identical in width to the slits 5 but of lesser length—see FIG. 1.

I claim:

1. For use in a printing machine having an ink roller, an ink doctor blade (1) having an ink metering edge (3) adapted for positioning close to the roller surface, said doctor blade (1) being formed with slits (5) extending from said metering edge to divide the blade into a plurality of tongues (4) separated by said slits (5), means to reduce the width of said slits to substantially zero, said means including a coating (15) applied to an edge (9) of at least one tongue (4) which faces a slit (5), said coating being of a material which is softer than the material of the doctor blade and initially of a thickness greater than the width of the slit (5), excess material of said coating (15) exceeding the width of the slit being sheared or cut off by an edge (10) of an adjacent tongue (4') facing the slit (5) formed between neighboring tongues (4,4') to thereby reduce the final thickness of said coating to substantially the width of the slit between said edges of a tongue and an adjacent tongue.

2. The doctor balde of claim 1, wherein the doctor blade, and hence the tongues comprise spring steel, and the coating of softer material applied to said edge (9) comprises galvanically deposited copper.

3. The doctor blade of claim 1, wherein the width of the slit formed between adjacent tongues is in the order of about 0.05 mm.

4. The doctor blade of claim 1, wherein the tongues (4,4') adjacent a slit (5) are formed with recesses (7, 8) extending longitudinally with respect to the slit, said recesses terminating approximately 1 mm short of said ink metering edge of the respective tongues;

and an elastic material (16) filling said recesses.

5. The doctor blade of claim 1, wherein said slits (5) are formed by a wire erosion machine operating in accordance with an erosion process.

6. The doctor blade of claim 1, wherein a plurality of auxiliary slits (11) are formed in said tongues.

7. The doctor blade of claim 6, wherein said auxiliary slits (11) are identical in width to said slits (5) separating said tongues, said auxiliary slits extending inwardly of said doctor blade for a distance less than the extent of said slits (5).

8. The doctor blade of claim 6, wherein said slits (5) and said auxiliary slits (11) are formed by a wire erosion machine operating in accordance with an erosion process.

* * * * *